United States Patent [19]

Slama et al.

[11] 4,057,185

[45] Nov. 8, 1977

[54] METHOD AND MEANS FOR OPERATING A PAIR OF PINCH ROLLS

[75] Inventors: Jerry L. Slama, Monroe; David J. Francis, Hamilton; Gordon R. Shepherd, West Chester, all of Ohio

[73] Assignee: Armco Steel Corporation, Middletown, Ohio

[21] Appl. No.: 714,316

[22] Filed: Aug. 16, 1976

[51] Int. Cl.[2] ..... B65H 23/22

[52] U.S. Cl. ..... 226/1; 226/42

[58] Field of Search ..... 226/1, 37, 40, 42, 44, 226/36, 24

[56] References Cited

U.S. PATENT DOCUMENTS

| | | | |
|---|---|---|---|
| 3,771,703 | 11/1973 | St. Denis | 226/42 |
| 3,905,533 | 9/1975 | Corse | 226/44 |

*Primary Examiner*—Richard A. Schacher

*Attorney, Agent, or Firm*—Melville, Strasser, Foster & Hoffman

[57] ABSTRACT

A method and apparatus for operating a pair of vertically disposed pinch rolls to facilitate the withdrawal of a strip of material from a rotatable mandrel is disclosed. The lower roll is operated conventionally at a preselected rotational velocity tending to advance the bottom surface of the strip through the rolls at a corresponding speed. The top roll is operated hydrostatically in response to strip speed and torque output feedback signals so as to maintain a constant output torque at a rotational velocity tending to advance the top surface of the strip at the monitored value of strip speed. As a result, the strip is advanced through the pinch rolls at a speed corresponding to the preselected rotational velocity of the bottom roll.

10 Claims, 3 Drawing Figures

METHOD AND MEANS FOR OPERATING A PAIR OF PINCH ROLLS

BACKGROUND OF THE INVENTION

The method and apparatus of the present invention relate to the operation of pinch rolls of the type utilized to facilitate the withdrawal of a strip of material from a rotatable mandrel or the like for subsequent processing. More particularly, the present invention relates to an improved system for at least partially operating a pair of pinch rolls by means of a hydrostatic drive unit wherein relatively low pinching forces are utilized to withdraw the strip material from the mandrel.

Continuous strip material, such as steel, is typically provided in tightly wound coils which are loaded onto a mandrel for subsequent delivery to various types of operational lines for processing. For example, it may be desired to cut the continuously coiled strip into flat sections of predetermined length prior to shipment of the steel to a customer. This is conventionally accomplished by uncoiling the strip from the mandrel and feeding it through a precisely controllable power shear such as is found in the well known Hallden shear line. It will, however, be appreciated that the accuracy with which the shearing operation is performed will be largely dependent upon the accuracy with which the strip material is itself delivered to the shear. That is, in order to achieve a repeatably accurate cut, the strip material must be delivered to the shear at some preselected speed which can be maintained substantially invariable.

Conventionally, the delivery of strip material, in particular steel, from a rotatable mandrel to a processing station, such as a power shear, is facilitated through the use of a pair of vertically disposed pinch rolls positioned between the supply mandrel and the processing station. The strip material is advanced through the closely spaced pinch rolls by means of frictional forces which result from the application of downward pressure, generally provided by a biased spring, on the top roll and the torque output from the bottom roll which is typically driven by an electric motor or the like. It is well known in the art that, when utilizing the aforementioned technique, relatively large pinching forces must be exerted on the strip by the rolls. In other words, in order to maintain the tangential velocity of the bottom driven roll and the strip speed equalized, the downward normal force exerted on the top roll must be quite high. These high frictional forces tend to induce increased roll wear and limit the useful life of the rolls.

In addition, to further increase the efficiency of prior art pinch rolls, it has been relatively common practice to employ patterned rolls, such as the spiral grooved rolls disclosed in U.S. Pat. No. 3,771,703 issued to St. Denis on Nov. 13, 1973, to increase the gripping forces exerted by the rolls on the strip. However, this approach frequently results in an undesirable roll pattern transfer to the strip material which is especially noticeable in cases where higher level pinching forces are required.

Moreover, due to the aforementioned method of operating prior art pinch rolls, slippage between the rolls and the strip material is a commonly experienced problem which is particularly encountered when running heavily oiled strip material through the rolls. It will be appreciated that such slippage will affect the rate of delivery of the strip to the processing station and, for example, in the case of a shearing operation, will result in irregularly sheared strip sections.

While the above discussion relating to prior art has, at times, referred to certain specific apparatus, it will be appreciated that it is known to use various equivalent devices in lieu thereof, although such use has not cured the various deficiencies previously discussed herein. For example, the previously mentioned St. Denis patent discloses the use of hydraulic means instead of an electrical motor for driving the bottom roll. Also, it is known to provide a downward normal force on the top roll through the agency of hydraulic means instead of springs. See for example, U.S. Pat. No. 3,349,981 issued to H. F. Hawkins et al, on Oct. 31, 1967. Therefore, although somewhat different means are utilized, the general prior art operating scheme of employing the pinching force-friction method of enslaving the top roll with a downward normal force to the driven bottom roll is retained.

SUMMARY OF THE INVENTION

To overcome the foregoing and other related deficiencies in the prior art, the present invention comprehends the use of a hydrostatic drive to provide a constant and preselected torque output to the top roll and controlling its speed to match the strip speed while, simultaneously and independently, operating the bottom roll in a conventional manner. The hydrostatic drive permits the required pinching force to be decreased and allows smooth pinch rolls to be employed. As a result, roll wear is decreased, roll pattern transfer to the steel product is essentially eliminated and roll slippage which affects shearing length is minimized.

More particularly, in the present invention, the lower one of a pair of vertically disposed pinch rolls is operated at a preselected rotational velocity tending to advance the bottom surface of a steel strip from a rotatable supply mandrel toward a processing station, such as a power shear, at a predetermined linear speed. Means are provided along the path of travel of the steel strip downstream of the pinch rolls for continuously producing an output signal indicative of the linear speed of the strip.

The top roll is operated by a hydrostatic drive unit comprising a variable displacement axial piston type pump which controls a motor connected for imparting a rotational drive to the roll. The pump includes a conventional swash plate whose position is controllable by a servo valve for varying the piston displacement of the pump wherein the output volume of the pump may be precisely controlled. The output signal representing the linear speed of the strip is fed back to the servo valve causing the hydrostatic drive unit to operate the top pinch roll independently of the bottom roll and at a rate such that its tangential velocity matches the strip speed.

In addition, a pressure transducer is connected for continuously monitoring the output pressure of the pump, and therefore the output torque developed by the motor, and for applying this information to a comparator. The comparator, which may be set to a preselected value of pressure or torque, continuously compares the monitored value with the preselected value and develops an error signal representing the deviation therebetween. The error signal is combined with the strip speed feedback signal applied to the servo valve as a result of which the hydrostatic drive unit attempts to slightly increase or decrease the rotational velocity of the top roll by slightly increasing or decreasing the pump volume output depending upon the magnitude and direction of the deviation. Due to the frictional resistance between the top roll and the strip, the error signal will not appreciably affect the speed of the roll but will cause the output torque developed thereby to adjust toward the preselected value. In this manner, the top roll may be operated at a constant preselected level of torque and at a speed matching the linear speed of the strip.

By independently driving both rolls as described above so as to match roll velocity with strip speed, the aforementioned deficiencies in the prior art are significantly minimized. Primarily, since both the top and bottom rolls are driven significantly smaller pinching forces are required. This decreases roll wear as well as roll slippage and obviates the necessity for employing patterned rolls.

DESCRIPTION OF THE PREFERRED EMBODIMENT

Figure 1:
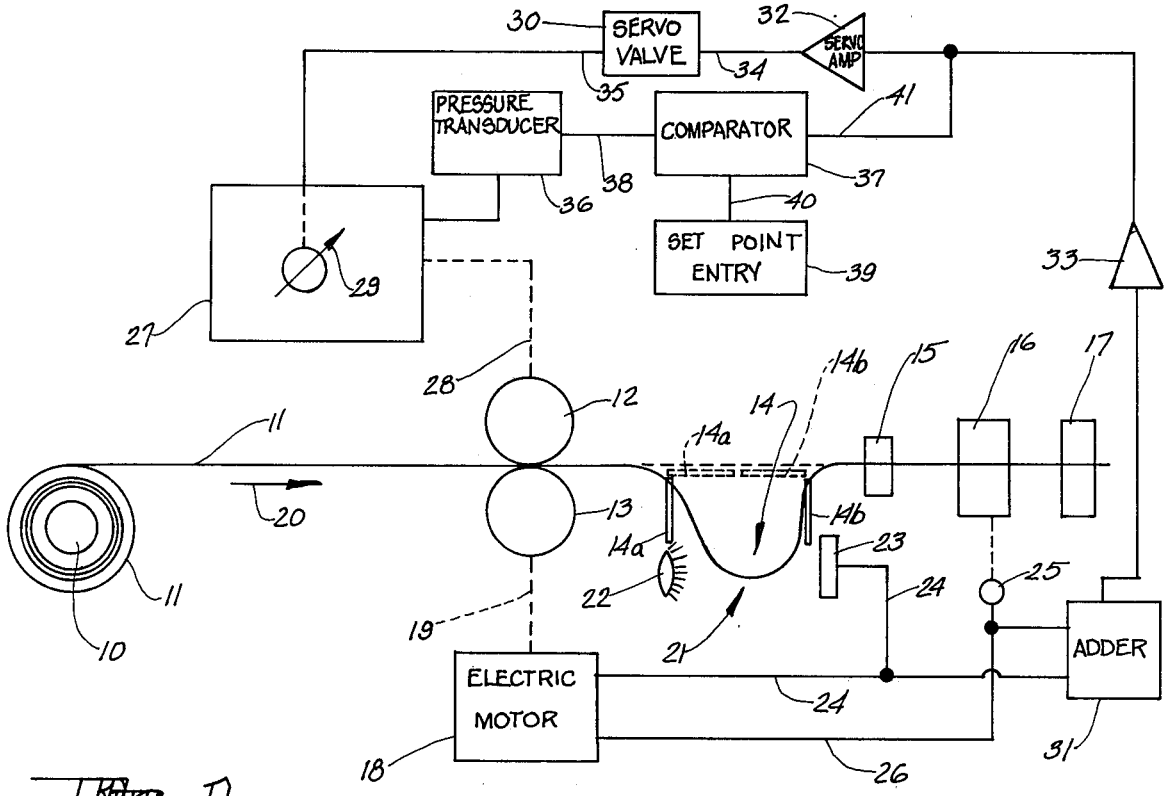
FIG. 1 is a schematic flow diagram illustrating the manner of use of the present invention in association with a pair of vertically disposed pinch rolls operated in association with a Hallden shear line.

Referring now to the drawings, wherein like index numerals are used to identify like components, the overall operation of the present invention is most conveniently described with respect to the schematic flow diagram shown in FIG. 1. In this regard, although FIG. 1 diagrammatically shows the operation of the present invention in association with a conventional Hallden shear line, it will be appreciated that such is exemplary only and not intended to be limiting. In other words, the present invention is considered applicable to any operation which employs a pair of pinch rolls to facilitate the withdrawal of a strip of material from a rotatable mandrel.

In FIG. 1 a conventional Hallden shear line is shown as comprising a rotatable mandrel 10 carrying a tightly wound coil of steel strip 11, a pair of vertically disposed pinch rolls 12 and 13, a loop pit indicated generally at 14, a side guide 15, a series of shear leveler rolls indicated generally at 16 and a Hallden shear knife 17. Typically, the bottom pinch roll 13 is driven by an electric motor 18, as indicated by dotted line 19, which may manually be preset to operate at a desired rotational velocity. Also, means (not shown) are generally provided for operating the mandrel 10 at a varying angular velocity to produce a constant strip speed. And, it will be recalled, that means (not shown) are conventionally provided for producing a downward normal force on the top pinch roll 12 to effectuate the necessary frictional forces between the roll 12, 13 and the strip material 11.

In the conventional operation of the line shown in FIG. 1, the operator initially depresses a jogging button or the like which operates mandrel 10 causing it to rotate at a slow speed and deliver the strip material 11 in the direction indicated by arrow 20 toward the pinch rolls 12 and 13. Actuation of the jogging button by the operator simultaneously initiates operation of the electric motor 18 which causes pinch rolls 12 and 13 to draw strip 11 therethrough toward looping pit 14. The strip 11 then passes above looping pit 14 on drop tables **14*a* and 14*b* to the shear leveler rolls 16 through the side guide 15. After initial feeding of the strip 11 into the rolls 16, the drop tables 14*a* and 14*b* swing down into the looping pit 14. The side guide 15 is utilized to appropriately guide the strip 11 and the shear leveler rolls 16 insure that the strip 11 is properly oriented before its delivery to shear 17**.

The looping pit 14 introduces a slack loop 21 into the strip 11 between the pinch rolls 12, 13 and the shear leveler roll 16 to provide means for compensating between possible strip speed differentials between the two sets of rolls. In this regard, a light source 22 is typically provided on one side of the slack loop 21 and an associated photocell receiver 23 is positioned on the other side of the loop 21. The light source 22 and photocell receiver 23 provide means for automatically measuring the extent of the loop 21 which is indicative of the speed of the strip 11 at the pinch rolls 12, 13 relative to its speed at the shear leveler rolls 16. For example, if loop 21 extends downwardly into the looping pit 14 by an excessive amount, the photocell receiver 23 develops an output signal on line 24 indicating that the speed of the strip 11 at pinch rolls 12, 13 is excessive. The output signal developed on line 24 may then be applied to electric motor 18 to appropriately reduce the rotational velocity of the bottom pinch roll 13. In a similar manner, a signal from tachometer 25, representative of the strip speed in the vicinity of the shear leveler rolls 16, is normally fed back over a line 26 to the electric motor 18 to provide additional means for matching the speed of the strip 11 at pinch rolls 12, 13 and at the shear leveler rolls 16.

Up to this point, the discussion herein relating to the operation of the pinch rolls 12 and 13 has been in terms of entirely conventional methods and techniques. That is, the pinch rolls 12 and 13 have been described as being operative for drawing strip 11 therethrough by means of imparting a rotational drive to the lower roll 13 while simultaneously applying a relatively large downward normal force to the top roll 12 in order to achieve the necessary frictional forces between the strip 11 and the rolls. As previously discussed herein, this method of operating the pinch rolls 12 and 13 leads to various related disadvantages which detract from the efficiency of the operation as well as from the integrity of the final processed product.

In accordance with the present invention, the disadvantages associated with the prior art are minimized by providing a constant torque output to the top roll 12 in addition to the torque provided the bottom roll 13 thereby reducing the downward normal course required to obtain the same total frictional forces for driving the strip 11. This is accomplished by means of a hydrostatic drive unit which is operatively connected to the top roll 12 and controlled by feed back signals which maintain the constant torque output and match the tangential velocity of the top roll 12 to the strip speed.

Accordingly, in FIG. 1 a conventional hydrostatic drive unit, indicated generally at 27, is shown as being operatively connected to the top pinch roll 12 by dotted line 28. As will be provided in further detail hereinafter, the hydrostatic drive unit 27 will typically include a variable displacement, axial piston-type pump for operating a motor operatively connected to the shaft carrying pinch roll 12. The output pressure developed by the pump, and thereby the torque developed by its associated motor and delivered to the pinch roll 12, is controllable in a conventional manner by operating a swash plate, diagrammatically indicated at 29, located within the pump to vary the pump's displacement capacity. In other words, the instantaneous position of the swash plate 29 determines the output volume developed by the pump, which is then utilized for operating the motor which drives the roll 12.

The position of the swash plate 29 is controlled by means of the servo valve 30 which is connected to a summing network 31 through a servo amplifier 32 and an optional preamplifier 33. The servo valve 30 is a conventional component which converts an electrical signal at its input 34 to a hydraulic signal at its output 35. Typical servo valves useful in this application are the SA4 and SC4 series servo valves manufactured by Vickers Company.

The inputs to the summing network 31 are taken from the outputs of the tachometer 25 and the photocell receiver 23. These signals, which represent the speed of the strip 11 are added by summing network 31 and applied through preamplifier 33 and servo amplifier 32 to the input 34 of the servo valve 30. The servo valve 30 then develops a proportional hydraulic signal at its output 35 which is used to control the position of the swash plate 29 so that the tangential velocity of pinch roll 12 follows the speed of the strip 11. Therefore, through the aforementioned feed back loop, the tangential velocity of the pinch roll 12 is effectively slaved to the speed of the strip 11.

A second feed back loop comprising the pressure transducer 36 and the comparator 37 is connected between the output of the pump of the hydrostatic drive unit 27 and the input to the servo amplifier 32. The pressure transducer 36 continuously monitors the output hydrostatic pressure of the hydrostatic drive unit pump and develops a signal proportional thereto which is applied to the comparator 37 over line 38. Since the pump pressure is proportional to the output torque applied to the pinch roll 12, the signal produced by the pressure transducer 36 on line 38 represents the torque at which the pinch roll 12 is being operated. The comparator 37 is preset to some preselected value of torque by means indicated generally by the set point entry block 39 and connection 40. The comparator 37 continuously compares the monitored value of torque from the pressure transducer 36 to the preselected value of torque and generates on output line 41 an error signal representative of the deviation therebetween. The error signal is applied to the servo valve 30 through the servo amplifier 32 for controlling the position of the swash plate 29 to maintain the output torque of roll 12 enslaved at the constant value represented by the preselected value of torque. In other words, if the output torque of roll 12 drops below the preselected value, an error signal will be developed by the comparator 37 which, through the servo amplifier 32 and the servo valve 30, will cause a slight repositioning of the swash plate 29 which, in turn, will attempt to cause a slight increase in speed of the roll 12. However, due to the frictional resistance between the roll 12 and the strip 11, this adjustment will be realized in terms of a slightly increased torque output of roll 12 rather than an increase in speed. And, of course, the slight increase in torque output of roll 12 will be in a direction toward the preselected value of torque entered in comparator 37. In a similar fashion, should the output torque of roll 12 rise above the preselected value, an error signal will be developed by comparator 37 tending to slightly reduce the torque output of roll 12 to match the preselected torque value. Therefore, through the feedback loop comprising pressure transducer 36 and comparator 41 the output torque of the pinch roll 12 will be maintained at a substantially constant preselectable value.

Figure 2:
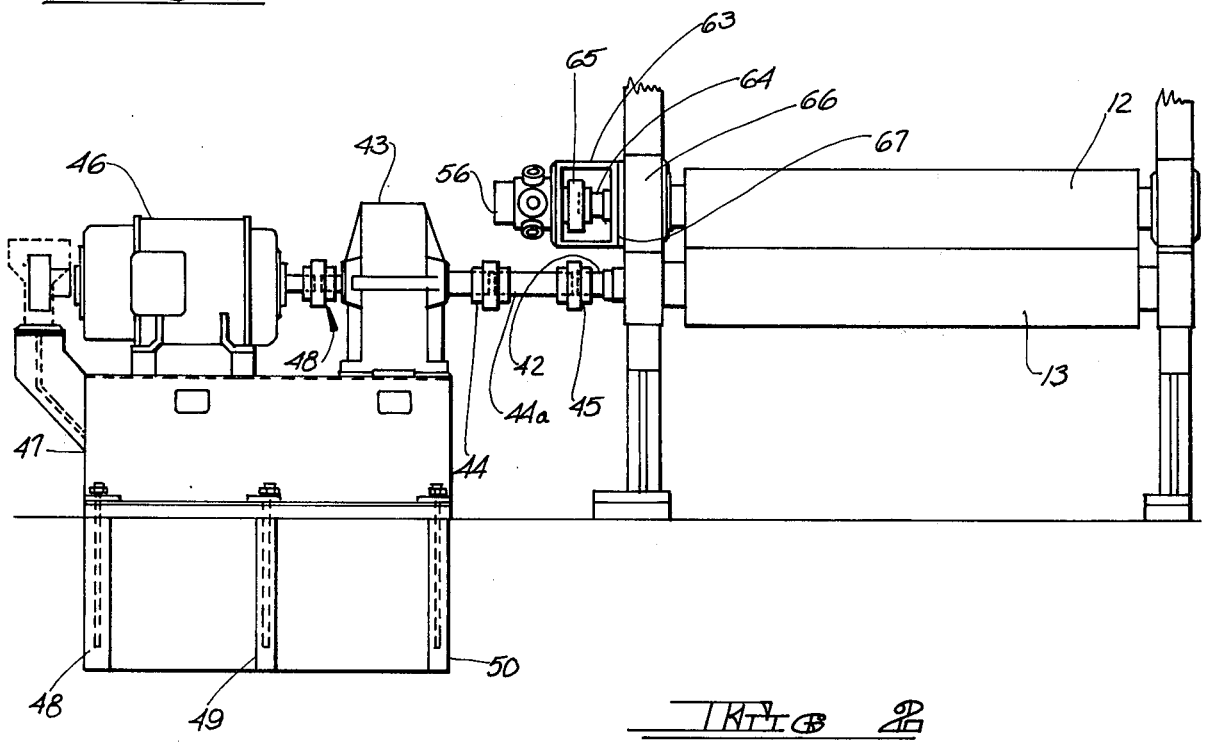
FIG. 2 is a side elevation view illustrating a pair of pinch rolls operatively connected to the drive system of the present invention.
Figure 3:
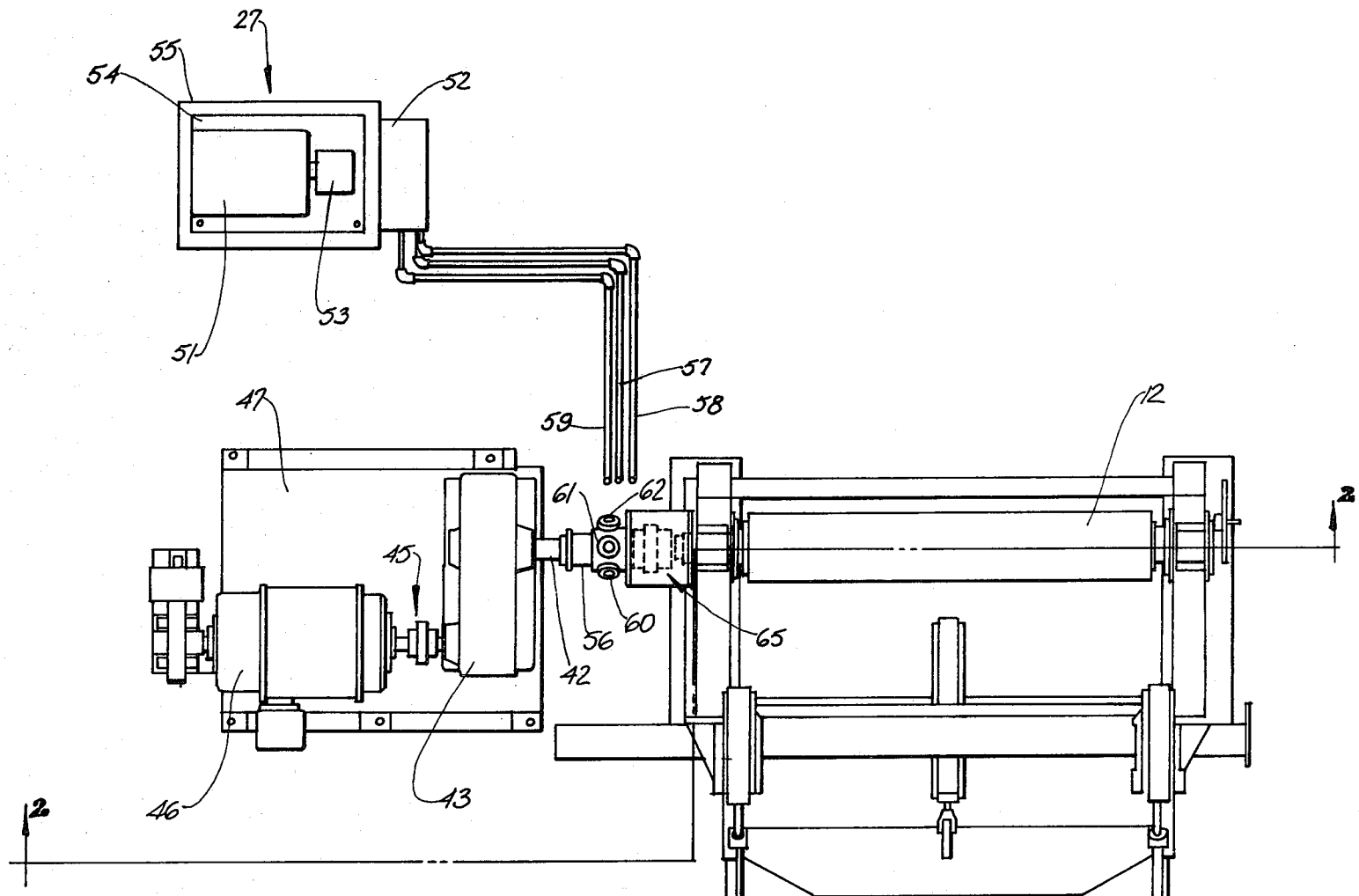
FIG. 3 is a plan view of the pinch rolls and drive system shown in FIG. 2.

The physical arrangement of the pinch rolls 12 and 13 and their associated drives is shown more clearly in FIGS. 2 and 3. The bottom roll 13, which could be driven hydrostatically, is conventionally carried on a rotatable shaft 42 and communicates with a gear box 43 through coupling members 44, **44*a* and 45. Gear box 43 is driven through coupling 45 by a conventional electric motor 46 which, along with gear box 34, may be supported on a platform 47. Typically, platform 47 is anchored to the floor by means of a plurality of anchoring bolts such as shown at 48, 49 and 50**.

The hydrostatic drive unit 27 comprises an electric motor 51 coupled to a hydraulic pump 52 by means of coupling member 53. For purposes of stability, the electric motor 51 and coupling member 53 may be mounted on a platform 54 anchored to a concrete slab 55. Typically, the motor 51 may be rated at about forty horsepower and 1200 rpm. The pump 52 is commercially available from various sources and may comprise, for example, a Sundstrand 23 series pump. The pump 52 will, of course, include the swash plate 29 as previously described which is operated to control the output of pump 52 as set forth herein.

The hydraulic pump 52 is connected to a hydraulic motor 56 by means of three wire braided hoses 57, 58 and 59. For purposes of an exemplary showing, hydraulic motor 56 may comprise a Sundstrand hydraulic motor Model No. MH21-JC or the like. The hydraulic motor 56 includes a series of fittings 60, 61 and 62 adapted to receive hoses 57, 58 and 59. Hoses 57 and 58 are, respectively, supply and return hoses whereby hydraulic fluid is applied from pump 52 to motor 56 for operating pinch roll 12. Hose 59 is a drain hose such as is typically included in hydraulic systems. It will be appreciated by one skilled in the art that the operation per se of the hydrostatic drive unit 27 is conventional and, for this reason, has not been described in any great detail herein.

In order to operate the roll 12, the hydraulic motor 56 is secured to a mounting bracket 63 and coupled to the output shaft 64 of roll 12 by means of coupling member 65. The mounting bracket 63 is secured adjacent bearing 66 on bearing retainer 67. In this manner, under the control of the hydraulic pump 52, the hydraulic motor 56, is adapted to impart a rotational drive to roll 12 independent of that imparted to roll 13 and in accordance with information provided by the feed back loops previously discussed.

From the foregoing, it will be apparent that the hydrostatic drive unit 27 provides a torque output to the top control 12 and therefore to the top of the steel strip 11 so as to drive the top of the strip forward at the same speed as the bottom roll 13 is driving the bottom of the strip. Moreover, the output torque of the unit 27 is a function of the preselected torque setting and is basically independent of the rotational speed of the roll 12. By thus providing a torque output to the top roll 12 in addition to the bottom roll 13, the pinching forces required are significantly reduced and many of the disadvantages associated with the prior art are eliminated or substantially minimized.

Although the present invention has been shown in connection with a specific embodiment, it will be readily apparent to those skilled in the art that various changes in form and arrangement of parts may be made to suit requirements without departing from the spirit and the scope of the invention.

The embodiments of the invention in which an exclusive property or privilege is claimed are defined as follows:

1. In an assembly of the type utilizing first and second pinch rolls on a processing line for engaging therebetween a strip of material to facilitate the withdrawal of said strip from a supply thereof and to advance said strip along said line, the improved apparatus for operating said pinch rolls comprising:

a. means for operating said first pinch roll at a preselected velocity so as to tend to advance said strip along said line at a desired linear speed;

b. means for operating said second pinch roll at a preselected value of torque;

c. means for monitoring the actual torque developed by said means for operating said second pinch roll;

d. means responsive to said torque monitoring means for developing an error signal representing the difference between said actual torque developed and said preselected torque value, said error signal being operatively connected to said means for operating said second pinch roll, whereby said actual torque developed is adjusted to minimize the magnitude of said error signal.

2. The improvement according to claim 1 including means for monitoring said linear speed of said strip along said line to produce a corresponding speed signal, said means for operating said second pinch roll being responsive to said speed signal and containing means for combining said error signal and said speed signal to produce a composite signal for operating said second pinch roll at said preselected value of torque.

3. The improvement according to claim 2 wherein said means for operating said first pinch roll at a preselected velocity is responsive to said speed signal so as to tend to advance said strip along said line at said desired speed.

4. The improvement according to claim 2 wherein said means for operating said second pinch roll includes hydrostatic drive means.

5. The improvement according to claim 4 wherein said torque monitoring means comprises a pressure transducer and wherein said means for operating said second pinch roll includes a servo valve responsive to said composite signal for operating said hydrostatic drive means.

6. In an operation of the type utilizing first and second pinch rolls on a processing line for engaging therebetween a strip of material to facilitate the withdrawal of said strip from a supply thereof and to advance said strip along said line, the improved method of operating said pinch rolls comprising:

a. positioning said first pinch roll for engaging said strip and operating said first pinch roll at a preselected velocity so as to tend to advance said strip along said line;

b. positioning said second pinch roll to engage said strip and operating said second pinch roll at a preselected value of torque;

c. monitoring the actual torque developed by said second pinch roll;

d. developing an error signal representing the difference between said actual torque developed and said preselected torque value; and e. adjusting said actual torque developed to minimize the magnitude of said error signal.

7. The method according to claim 6 including:

a. monitoring said linear speed of said strip along said line to produce a corresponding speed signal; and b. combining said error signal and said speed signal to produce a composite signal for operating said second pinch roll at said preselected value of torque.

8. The method according to claim 7 wherein said first pinch roll is responsive to said speed signal for operating said first pinch roll at said preselected velocity.

9. The method according to claim 7 wherein said second pinch roll is operated by hydrostatic means.

10. The method according to claim 9 wherein said torque is monitored by a pressure transducer and said second pinch roll is operated by a servo value responsive to said composite signal and operatively connected to said hydrostatic means.

* * * * *